United States Patent [19]

Leonardi, Jr.

[11] 4,378,118

[45] Mar. 29, 1983

[54] ACTION GAME

[76] Inventor: Alfred J. Leonardi, Jr., c/o Gameshop, Inc., 46 Dougherty St., Manchester, Conn. 06040

[21] Appl. No.: 250,420

[22] Filed: Apr. 2, 1981

[51] Int. Cl.[3] ..... A63F 1/00; A63F 9/00

[52] U.S. Cl. ..... 273/292; 273/1 R; 434/14; 434/237

[58] Field of Search ..... 273/1 R, 292, 308; 434/14, 38, 237

[56] References Cited

PUBLICATIONS

"Ace of Aces", Games, Jan./Feb. 1981, p. 52.

Title page & copyright page of "Germans" Book of Game entitled Ace of Aces, copyright 1980 by Alfred Leonardi.

*Primary Examiner*—Anton O. Oechsle

*Attorney, Agent, or Firm*—Hayes & Reinsmith

[57] ABSTRACT

An action game for at least two players comprising at least two sets of organized picture generating elements, for example books or card decks, which illustrate interaction between objects controlled by the players, for example at least two airplanes in a game simulating aerial combat. Each element such as a book page includes a picture of one game object as seen from the other game object controlled by one of the players, and each element depicts a different spatial relationship between the game objects. Each element also includes a plurality of maneuver symbols spaced from the picture and each indicating a different maneuver selectable for the game object controlled by the player viewing the picture and controlling the object from which the view is seen. Each element also includes a plurality of destination symbols, for example page numbers, one for each maneuver symbol and located in spaced, proximate relation to and in visual correspondence with the maneuver symbols. The destination symbols serve as pointers to particular ones of the picture generating elements as determined by player selection of the maneuver symbols. The destination symbols are provided by a method and apparatus utilizing a graphical network of identical geometric figures, for example equilateral polygons, the particular figure selected to approximate the motions and facings of the game objects and the network including a defined portion in space representing the field of view from a game object.

8 Claims, 9 Drawing Figures

ACTION GAME

BACKGROUND OF THE INVENTION

This invention relates to the art of interactive testing, education and amusement activities, and more particularly to a new and improved interactive game including visual representation of two or more relatively movable and interacting objects controlled by players and a method and apparatus for making the same.

Conventional board-type games are played by two or more persons in proximity to the board controlling player pieces or game objects in relation to a playing surface. Such games require the players to be in the same location for access to the board, and they have limitations on the degree to which they enable each player to experience a feeling of actual involvement in the action situation being simulated. It therefore would be highly desirable to provide an action type game-like activity simulating interactions of two or more relatively movable player controlled objects in which each player is more closely made a part of the action simulated and wherein the various players need not be in the same physical location.

SUMMARY OF THE INVENTION

It is, therefore, an object of this invention to provide a new and improved action-type game-like activity including visual representations of two or more relatively movable and interacting game objects controlled by players and a method and apparatus for making the same.

It is a further object of this invention to provide such a game wherein the interactions of two or more relatively movable game objects controlled by the players are depicted to the players in a manner showing each player his own point of view of the action and allowing each player his own choice of future actions.

It is a still further object of this invention to provide such a game which does not require the players to be present at the same physical location.

It is a further object of this invention to provide such a game which is highly challenging and adaptable to a large variety of conditions and requirements promoting exercise of skill and strategy by the players.

It is an additional object of this invention to provide such a method and apparatus for arranging the visual representations provided by the game and for generating a code which enables each player to visualize his own subjective point of view of the game field of play in which the player-controlled objects interact.

The present invention provides an educational, testing and/or amusement activity for at least two players comprising first and second means each for generating a plurality of visual representations of two relatively movable and interacting game objects controlled by the two players, the generating means each comprising a plurality of consecutively ordered picture generating elements, each such element including a picture or other representation of one game object controlled by one of the players as seen from the other game object controlled by the other one of the players, each element of each generating means depicting a different relationship between the two game objects. Each generating means can be in the form of a book with the pages thereof serving as the picture generating elements. A plurality of symbols of a first type are provided on each picture generating element each symbol indicating a different, selectable manuever for the game object controlled by the player viewing the picture and controlling the objects from which the picture is seen. A plurality of symbols of a second type are provided on each picture generating element in spaced, proximate relation to said first type symbols, there being one second type symbol for each first type symbol and located in visual correspondence therewith. The second type symbols serve as pointers to particular other ones of the picture generating elements as determined by selection of the maneuver symbols. The second type symbols are provided by a method and apparatus utilizing a graphical network of identical geometric figures, for example equilateral polygons, the particular figure selected to approximate the motions and facings of the game objects and the network including a defined portion representing the field of view from a game object.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF AN ILLUSTRATIVE EMBODIMENT

Figure 1:
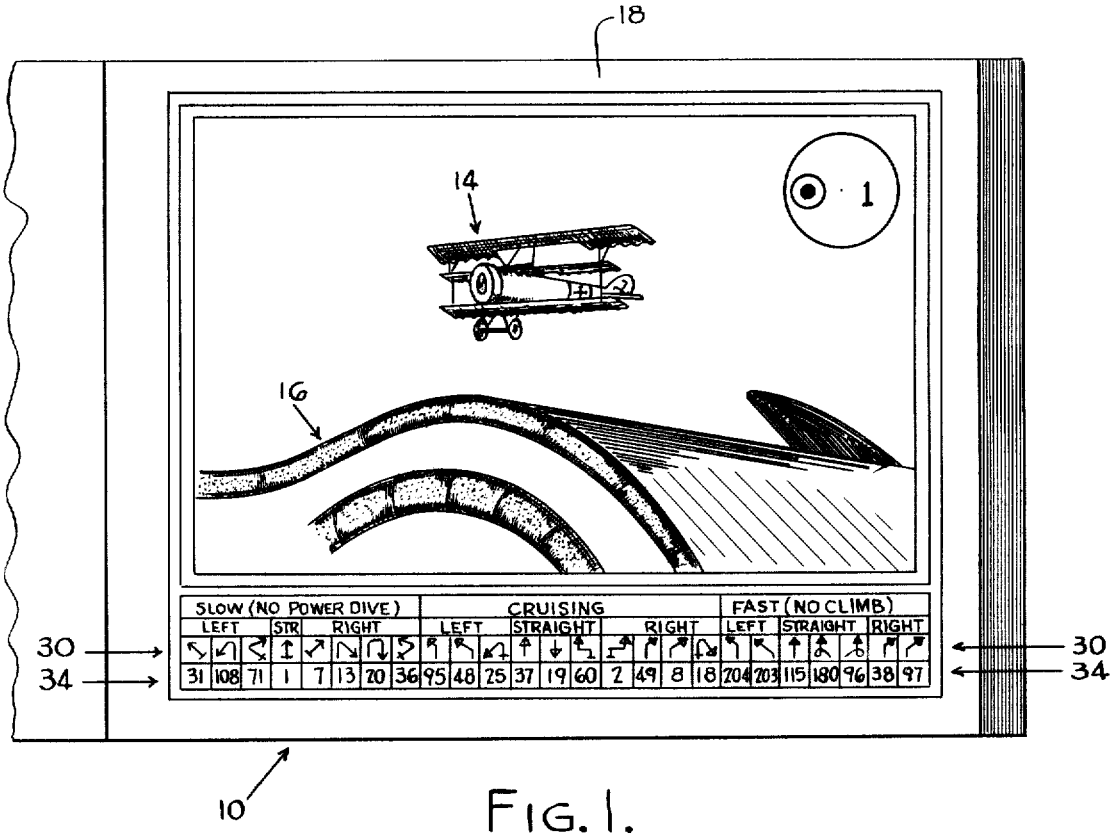
FIG. 1 is a fragmentary perspective view of one book employed in the game of the present invention and turned to a starting page of an illustrative game sequence.

Referring now to the drawings, the game according to the present invention comprises first and second means for generating a plurality of visual representations of two relatively movable and interacting game objects controlled by two players. In the illustrative game shown, the first and second generating means are in the form of a first book 10 shown in FIG. 1 and a second book 12 shown in FIG. 2. Each book comprises a plurality of pages, and each page contains a visual representation of the two game objects. Alternatively, the generating means can be in forms other than books, for example each generating means can be a separate ordered series of cards. As shown in FIG. 1, the pages of the book 10 comprise a plurality of consecutively ordered picture generating elements. In the game shown, the pages are consecutively ordered by page numbers located in the upper corner of the page. Each page or picture generating element contains a picture of one game object as seen from the other game object controlled by one of the players. Furthermore, each different page of the book contains a picture of a different relationship between the game objects. In addition, the same numbered or ordered pages of the two books contain the same relationship between the two game objects, but the pictures show the objects as seen by the respective players as will be described in more detail presently.

The illustrative game simulates aerial combat between two World War I airplanes, the Allied plane being controlled by one player and the German plane being controlled by the other player. Many other types of situations involving a plurality of relatively movable, player controlled objects can be simulated by the game of the present invention. These can include, for example, spaceships, tanks and boats, to mention a few. As shown in FIG. 1, the game book 10 for the player in the position of the Allied pilot shows a view of a German plane 14 as seen from the cockpit of the Allied plane 16. On the particular page 18 of book 10, the German plane is rearwardly and to the right side of the Allied plane. In FIG. 1, for purposes of identification the Allied symbol is provided in the upper right hand corner of the page adjacent the page number, and in addition the German plane 14 is marked with the German symbol. All the other pages in the book 10 show different relationships between the two planes, for example tailing, headon, or different lateral relationships as well as different distances between the planes and combinations of the positional and locational relationships. Similarly, the game book for the player in the position of the German pilot shows a view of the Allied plane 16 as seen from the cockpit of the German plane 14. On the particular page 20 of book 12 shown in FIG. 2, the Allied plane 16 is forwardly of and to the left of the German plane 14 which is in tailing relation to the Allied plane. This is indicated to the player by the symbol "T" which is located in the upper right hand corner of the page adjacent the German symbol and the page number. Also, the Allied plane 16 is marked with the Allied symbol. All other pages of book 12 show different relationships, for example tailing, headon or different lateral relationships as well as different distances between the two planes and combinations of the positional and locational relationships. In the illustrative game shown, the pages of both books show the two planes at close, medium and long range, at rear, front, right and left rear side, right and left front side and full side facings, and at windscreen, right and left forward wing, right and left wingtip, right and left tail, and tail views.

Figure 2:
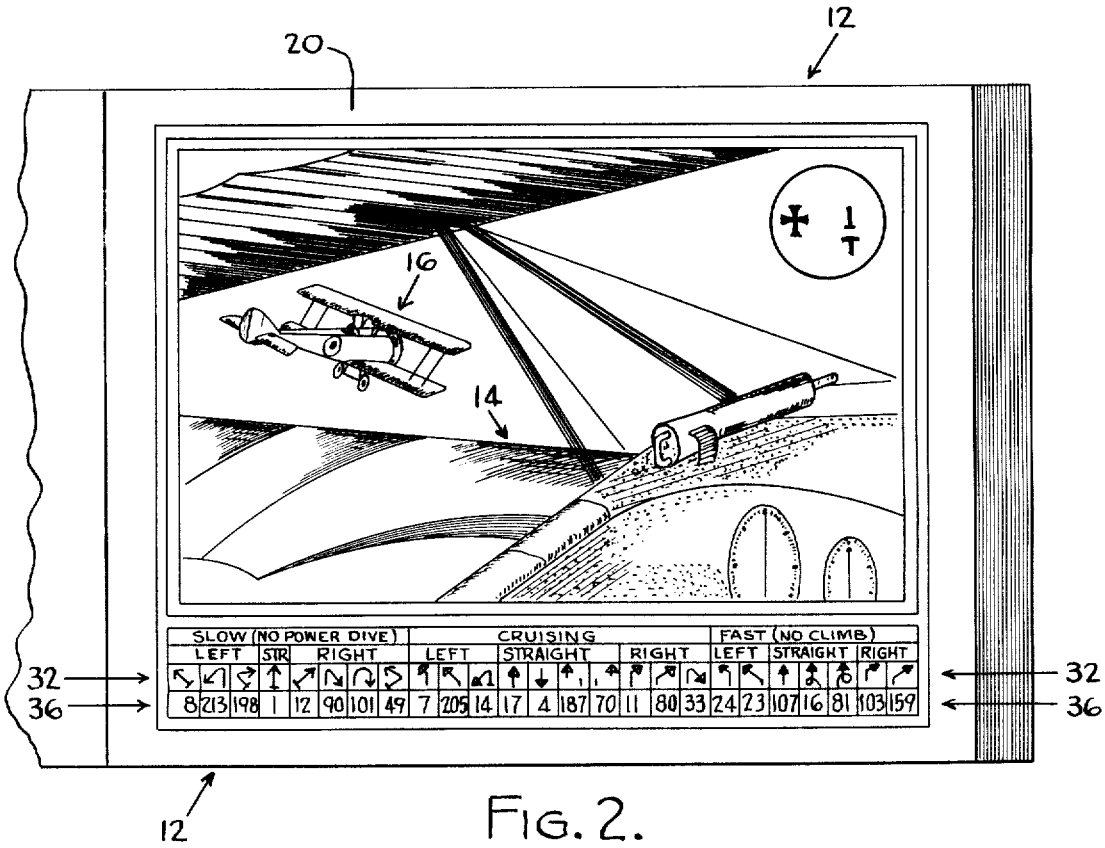
FIG. 2 is a fragmentary perspective view of another book employed in the game of the present invention and turned to a starting page of an illustrative game sequence.

In the game according to the present invention, the same ordered or numbered pages in the two books show the same relationship between the game objects, i.e. the Allied and German airplanes, but as seen by the respective player. Thus, pages 18 and 20 of books 10 and 12, respectively, shown in FIGS. 1 and 2 illustrate the same positional and locational relationship between the two airplanes but as seen from the other. These two pages have the same number, here the number 1 or other appropriate identification. Any two other pages having the same number or identification in the respective books will illustrate a different positional and locational relationship between the two airplanes as compared to page number 1 of the two books or as compared to any other pages of the books.

The game of the present invention further comprises a plurality of symbols of a first type on the picture generating elements, each symbol indicating a different maneuver for the game object controlled by the player viewing the picture and controlling the object from which the view is seen. For convenience, these symbols are collectively designated 30 on the page of book 10 shown in FIG. 1 and collectively designated 32 on the page of book 12 in FIG. 2. In the game shown, there are 25 different symbols which identify a corresponding different number of maneuvers. A maneuver is selected for the object, i.e. the airplane, controlled by the player as will be explained in detail. The number of maneuvers in a particular game can be smaller or larger depending upon the type of the game. In addition, in the game shown the symbols given some graphical indication of the type of maneuver. Also, the maneuvers are arranged in the broad categories according to speed indicated "slow", "cruising", and "fast", and within those in the directional categories of "left", "straight" and "right". For example, in the category of slow maneuvers, the maneuver indicated by the straight arrow with a perpendicular line at the end opposite the arrow head is a stall maneuver where the plane is inclined so that the wings no longer provide lateral lift and the plane then noses down for a short distance until the wings begin to provide lift again. As shown in FIGS. 1 and 2, the stall maneuvers are in the left, straight, and right directions. The other maneuvers in the slow category are weaving and banking type maneuvers. By way of further example, in both the cruising and fast speed categories, there are turn maneuvers in both left and right directions wherein the straight portion of the symbol is relatively longer and bank type maneuvers in left and right directions wherein the angled portion of the symbol is relatively longer. Other maneuvers include wingovers, turns, sideslips and rolls.

The game of the present invention further comprises a plurality of symbols of a second type on the picture generating elements in spaced, proximate relation to the first type symbols. There is one second type or destination symbol for each first type or maneuver symbol and located in visual correspondence therewith. The destination symbols serve as pointers to particular other ones of the picture generating elements or pages as determined by selection of the maneuver symbols. For convenience in illustration, the destination symbols are collectively designated 34 on the page of book 10 in FIG. 1 and the destination symbols are collectively designated 36 on the page of book 12 shown in FIG. 2. The destination symbols are equal in number to the maneuver symbols. In the game shown, the destination symbols are numbers which correspond to page numbers of the books. The destination symbols are located closely adjacent the maneuver symbols, in particular each number is directly below a maneuver symbol as viewed in FIGS. 1 and 2. When a player viewing a picture on one of the pages of his book selects a maneuver for his controlled object, i.e. the airplane in the game shown, the page number corresponding to that selected maneuver indicates the next page to which the game proceeds in a manner which will be described. The game of the present invention is played in the following manner. Briefly, the players agree to determine the starting page number and turn to that page in their respective books. Each player sees the location of the other player's object, i.e. airplane, in his field of view. Each player selects a maneuver for his object, the maneuver symbols having arrows which indicate the direction of forward motion of the object. Each player calls out the number below the selected maneuver. The number called out by each player is known as the mid-turn number for the other player. Each player then turns to the page in his book corresponding to the mid-turn number given to him by the other player. The players disregard the pictures on the mid-turn or intermediate page but they look on that page for the maneuver they originally selected and call out the number below that maneuver. This number is the end-turn number and will be the same for each book. Both players then turn to that page and assess the event depicted thereon, i.e. one player may be shooting at the other thereby giving the one player a certain score, or the one player may be tailing the other player giving that one player an advantage during the next sequence of play. Many other possibilities can of course be incorporated in the game subject matter.

Figure 3:
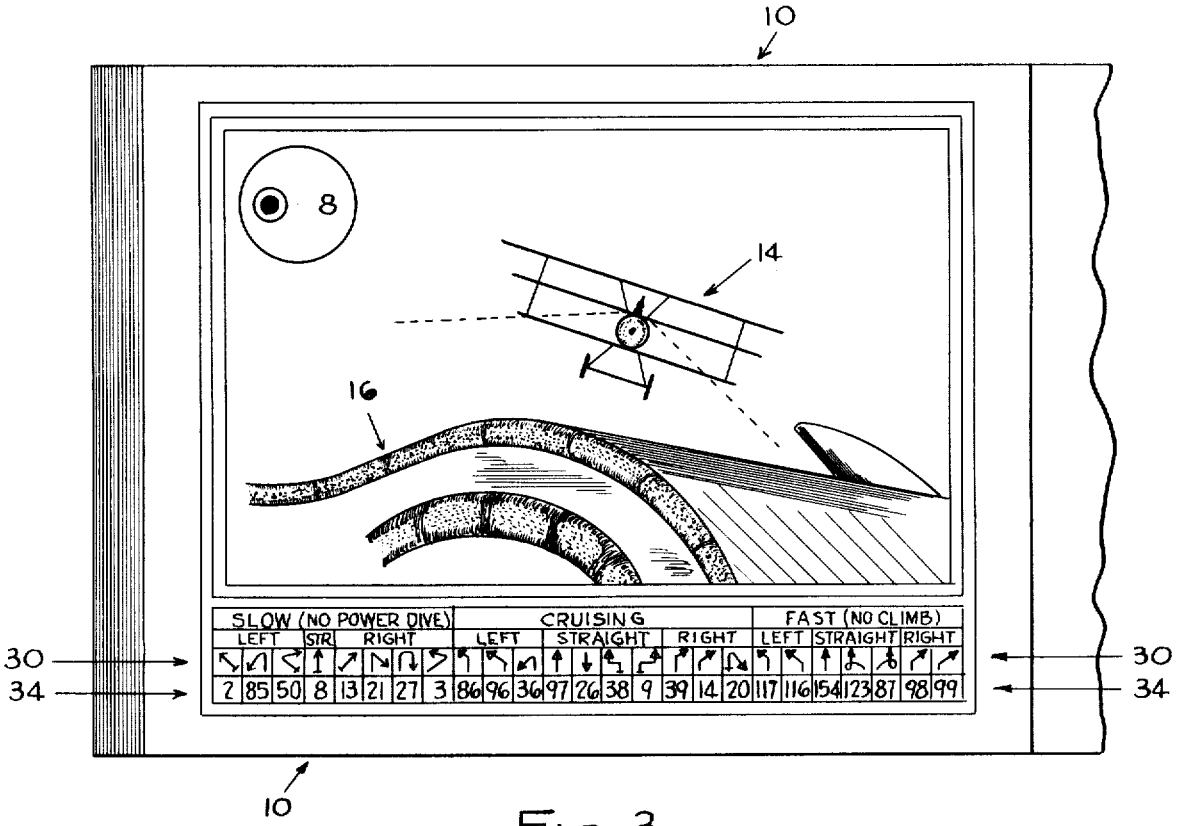
FIG. 3 is a fragmentary perspective view of the book of FIG. 1 turned to an intermediate page of the sequence.
Figure 4:
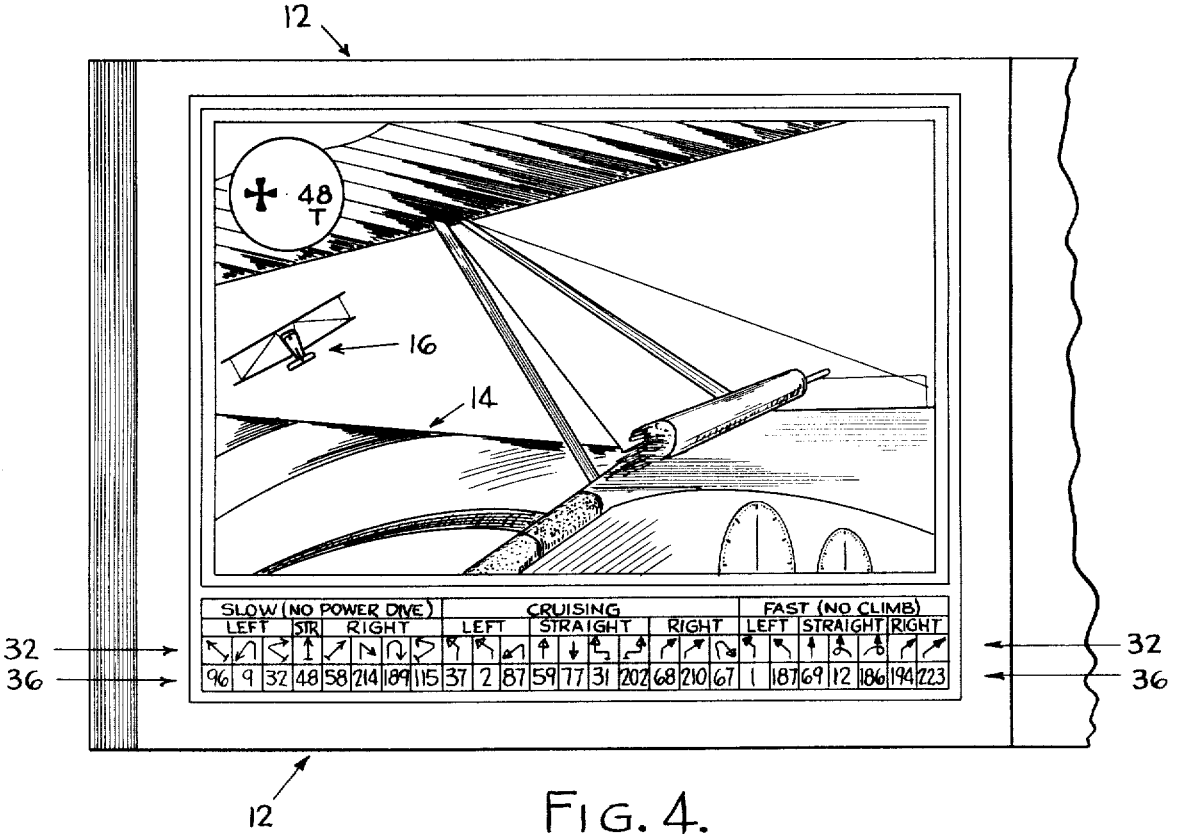
FIG. 4 is a fragmentary perspective view of the book of FIG. 2 turned to an intermediate page of the sequence.
Figure 5:
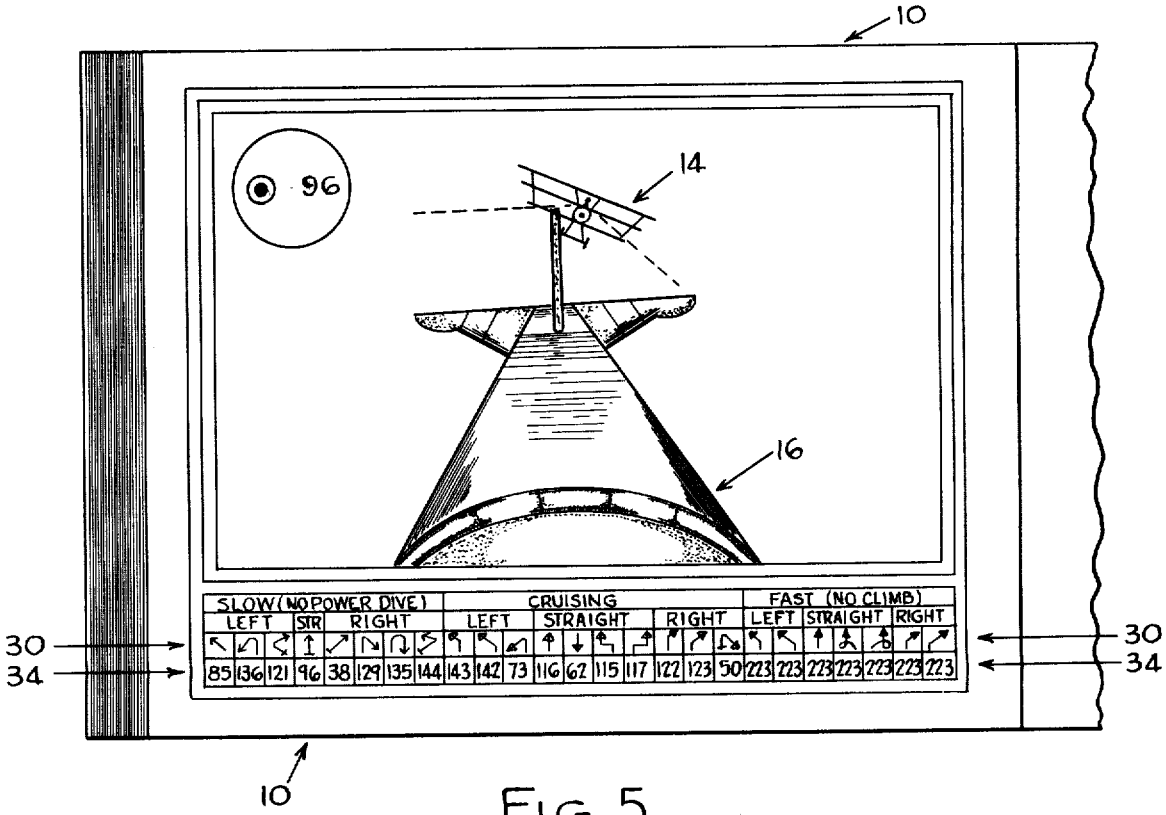
FIG. 5 is a fragmentary perspective view of the book of FIG. 1 turned to the final page of the illustrative game sequence.
Figure 6:
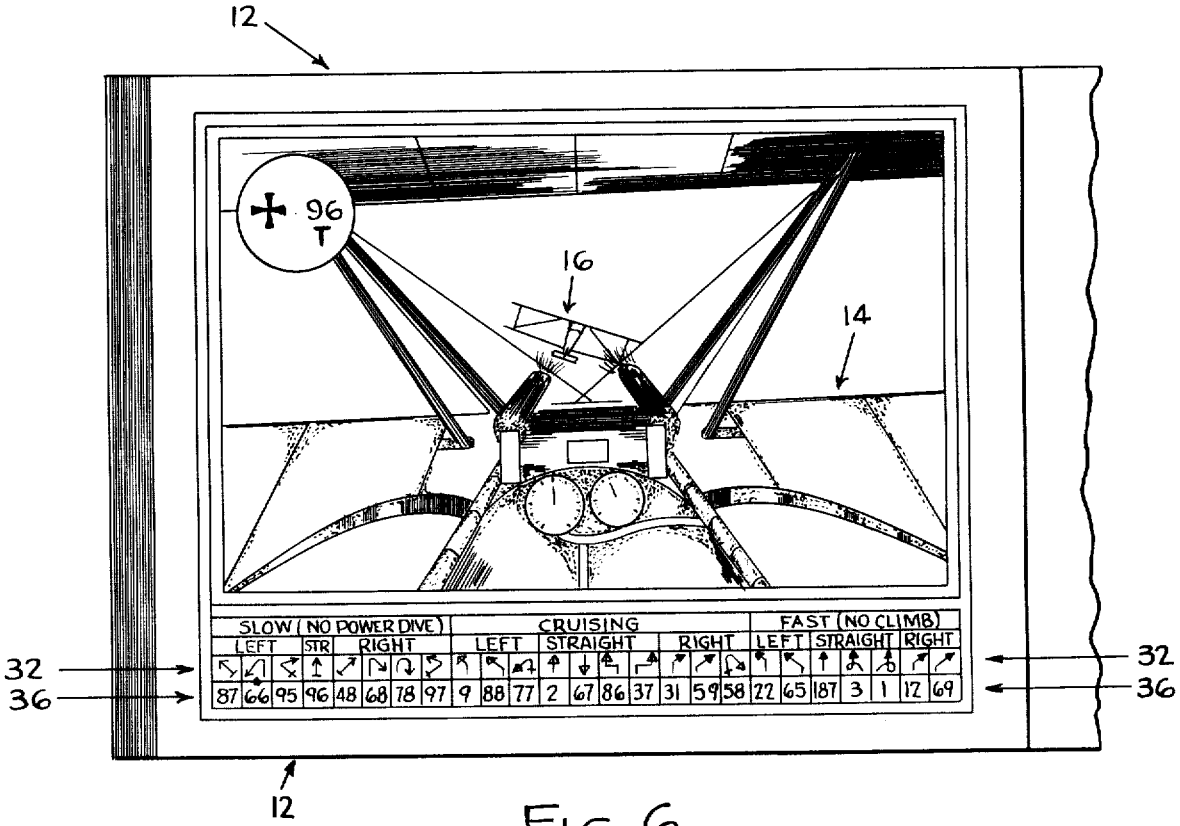
FIG. 6 is a fragmentary perspective view of the book of FIG. 2 turned to the final page of the illustrative game sequence.

The foregoing brief summary of game operation will be illustrated by the following example. Assume that the starting point for this illustrative sequence is page 1 as illustrated in FIGS. 1 and 2. No plane is in the windscreen view of the other plane so no shots are fired. Assume further that during the immediately preceding game sequence the Allied player was being tailed by the German thereby giving the German an advantage so that on this sequence the Allied player must give a clue to the German player regarding the next maneuver. For example, the Allied player gives the clue of a left maneuver. The German player then selects the slow left stall maneuver and records the mid-turn page number below that maneuver which is page 8 as shown in FIG. 2. Because of the previously given clue, the Allied player must select a left maneuver, and assume that he selects a left bank maneuver at cruising speed and records the mid-turn page number below that maneuver which is 48 as shown in FIG. 1. Then both pilots tell the other the mid-turn page number they have recorded, in particular the Allied pilot tells the German pilot to go to page 48 and the German pilot tells the Allied pilot to go to page 8. The players then turn their respective books to these pages, i.e. to the mid-turn pages they have been told. The Allied pilot turns to page 8 as shown in FIG. 3 and the German pilot turns to page 48 as shown in FIG. 4. The pilots disregard the pictures on these pages but they look or the symbol of the maneuver they originally selected for this sequence. In particular, the German pilot shown in FIG. 4 looks under the slow left stall maneuver and sees the page number 96 which he records. This is the end-turn page. Similarly, the Allied pilot looks under the left bank maneuver and sees the end-turn page number 96. As previously described, the end-turn pages will always be the same. Both pilots then turn to page 96 as illustrated in FIGS. 5 and 6. They check for shots, finding that the Allied pilot is being shot as depicted in both the figures. A particular score for this type of shot then is given to the German player. Since the Allied pilot still has the German on his tail, he again must give a clue for the next sequence of play.

Various additional factors may be introduced into the game, only a few which will be discussed for purposes of illustration. As previous mentioned, various pages will show the airplanes in different distance relationships, so that different score values can be assigned to shots at close, intermediate and long range. Also, different scoring values can be awarded depending upon which particular part of the plane is being shot. In addition, certain maneuvers can be selected only after a particular previous maneuver has taken place. Also, altitude factors can be introduced to affect the player's choice of maneuvers.

From the foregoing example, it is apparent that the game of the present invention advantageously depicts a high degree of realism and gives each player a feeling of deep involvement in the action situation being simulated. Another important advantage of the game of the present invention is that the players need not be in physical proximity, they only need to be in communication with each other. Therefore, the players can be at remote locations, each player having his own book with him, and the two players can be in communication by telephone or radio or other means. In addition, with the number of possible maneuvers and additional factors which may be added to the substance of the game, it is highly challenging and adaptable to a large variety of conditions and requirements promoting exercise of skill and strategy by the players. While the game described herein includes books or series of cards for generating the pictures, the principles of the present invention may be applied to programmed electronic game apparatus wherein the pictures could be displayed on two or more screens of such apparatus.

The game of the present invention is constructed in the following manner. For convenience, the method and apparatus described herein will be for making a game including three maneuvers, it being understood that the principles of the present invention apply equally to a game having as many as 25 maneuvers as illustrated in FIGS. 1–6 or to games with any number of possible maneuvers. The method and apparatus according to the present invention generates a code which enables each player to visualize his own subjective view of the field of play when two or more players control objects that interact. The end result of the method and apparatus described herein is a set of organized books, decks of cards or the like which show each player, through pictures,, his own point of view of the game action and allows the player his own choice of future maneuvers. The method and apparatus used to generate the code and arrange the pictorial views is as follows.

By way of definition, the object is either the subject or target and is one of the player-controlled objects in the game as seen by the other player. The subject is an object that one player controls, and the target is the object controlled by another player. The field of play is the space in which the subject is present and in all surrounding spaces that can be seen from that space if the subject were physically placed in that space and facing the surroundings. Each player of the game sees his object as the subject and the other objects as the targets.

Figure 7:
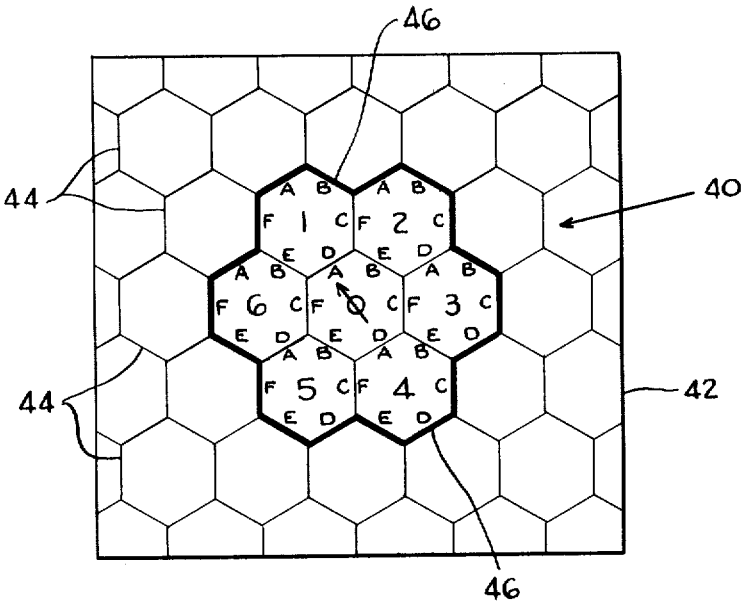
FIG. 7 is an elevational view of a sheet member provided with a graphical network of geometric figures used in making the game of the present invention.

Referring now to FIG. 7, a grid or network is provided which comprises a pattern of interconnected geometric figures of the same size and shape on a sheet member. A grid pattern is selected which approximates the motion and facings of the game objects. In the illustrative game with three maneuvers a polygon in the form of a six-sided geometric figure or hexagon is the geometric figure of the grid. An illustrative grid 40 is shown in FIG. 7 which can be drawn with pencil or pen on a sheet member 42 of paper or like material and which comprises a plurality of interconnected hexagons 44 of the same size. A central polygon of the grid is labeled 0 as shown in FIG. 7. A starting direction in the central polygon is selected and designated by an arrow as shown, and the side or facing of the central polygon in that starting direction is labeled A. The remaining sides are labeled B–F successively in a clockwise direction as shown. Next, the adjacent polygon in the direction of the arrow is labeled 1 and the remaining polygons are labeled 2–6 in a clockwise direction. The facings of the polygons 1–6 are labeled A–F in the same manner as the central polygon.

Figure 8:
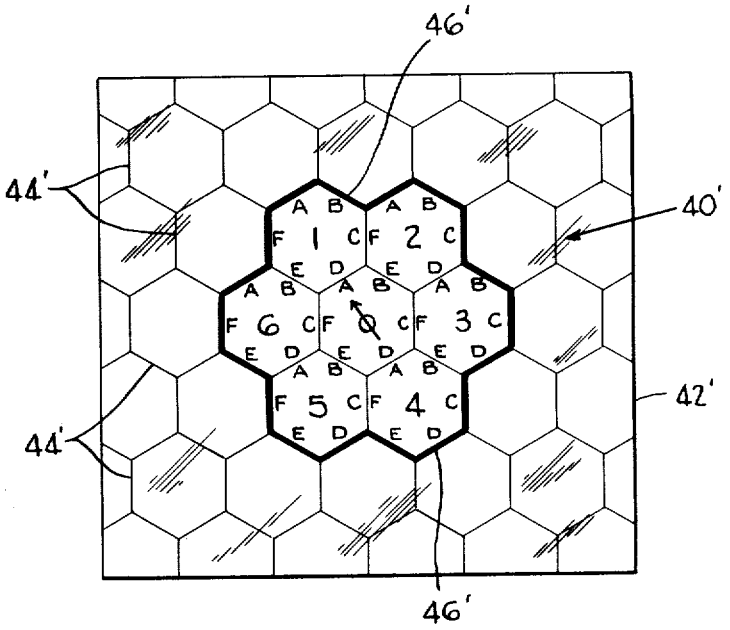
FIG. 8 is an elevational view of a sheet member similar to the member of FIG. 7 but of transparent material and provided with a similar graphical network of geometric figures.

Next, a transparency of the grid is made on a sheet of transparent material such as plastic or the like to provide a pattern identical to that on the sheet 42. The transparency 40' of the grid 40 is shown in FIG. 8 on a sheet 42' of transparent material such as plastic including interconnected polygons 44' provided by ink or the like on the sheet 42' by tracing or other suitable processes. Then a process calculating arrangement is defined on both the sheet member 42 of FIG. 7 and the transparency 42' of FIG. 8 by providing an outline 46,46' of the periphery of the geometric figures or polygons surrounding a single central polygon. The borders or outlines 46 and 46' on sheet 42 and transparency 42' respectively, are defined by the exposed outer sides or facings of the polygons 1–6 which surround polygon 0. This is equivalent to imagining that the subject is in the central polygon space 0 and eliminating all of the spaces or figures on the grid outside the subject's field of vision. Upon completion of the process calculating arrangement, the number of polygons in the arrangement is multiplied by the number of sides or facings of any of the polygons in the grid. The resulting product is the total number of picture generating elements in the generating means for that object, i.e. the total number of pages of a book or number of cards of a deck serving to create a stop-action picture book game for that object. In the illustrative game, with seven polygons in the process calculating arrangement and with each polygon having six sides or facings, the resulting product is 42.

In the apparatus shown, the process calculating arrangement includes the seven polygons 0–6, and the entire collection or total of polygon facings represents all of the possible positions for a subject in the process calculating arrangement, for example 0A, 0B, 0C, . . . 1A, 1B, 2A, etc. These facing identifications or possible positions are located in a tabular or sequential arrangement on a record member, such as in a column on a sheet of paper as illustrated in Table I herein which presents the polygon facing identification.

TABLE I

| Polygon Facing Identification | | | | | |
|---|---|---|---|---|---|
| Polygon Facing | Page # Object 1 | Page # Object 2 | Polygon Facing | Page # Object 1 | Page # Object 2 |
| 0A | 37 | 37 | 3D | 4 | 4 |
| 0B | 38 | 39 | 3E | 34 | 14 |
| 0C | 41 | 40 | 3F | 10 | 8 |
| 0D | 42 | 42 | 4A | 16 | 2 |
| 0E | 40 | 41 | 4B | 23 | 31 |
| 0F | 39 | 38 | 4C | 29 | 32 |
| 1A | 2 | 16 | 4D | 5 | 5 |
| 1B | 8 | 10 | 4E | 33 | 28 |
| 1C | 13 | 27 | 4F | 11 | 9 |
| 1D | 20 | 20 | 5A | 17 | 3 |
| 1E | 26 | 18 | 5B | 24 | 36 |

TABLE I-continued

| Polygon Facing Identification | | | | | |
|---|---|---|---|---|---|
| Polygon Facing | Page # Object 1 | Page # Object 2 | Polygon Facing | Page # Object 1 | Page # Object 2 |
| 1F | 36 | 24 | 5C | 30 | 25 |
| 2A | 3 | 17 | 5D | 6 | 6 |
| 2B | 9 | 11 | 5E | 32 | 29 |
| 2C | 14 | 34 | 5F | 12 | 22 |
| 2D | 21 | 21 | 6A | 1 | 15 |
| 2E | 27 | 13 | 6B | 7 | 35 |
| 2F | 35 | 7 | 6C | 18 | 26 |
| 3A | 15 | 1 | 6D | 19 | 19 |
| 3B | 22 | 12 | 6E | 25 | 30 |
| 3C | 28 | 33 | 6F | 31 | 23 |

Next, the number of lettered facings in the processing calculating arrangement is determined, which is the product of the number of facings in one polygon times the total number of polygons in the arrangement. In the illustrative game the product or total is 42 as previously described. With this total number in mind, numbers up to this total are randomly assigned in correspondence with the facings in the polygon facing identification. These numbers will serve as page numbers in one of the books ultimately produced containing the pictures seen from one of the game objects. In particular, in Table I another column labeled Page Number, Object 1 contains the randomly arranged numbers as shown. The numbers are assigned to the lettered facings randomly, one to each facing, with the same number never being used twice. Then, a further column is provided in the polygon facing identification which is identified in Table I as Page Number, Object 2. The information for that column is derived in the following manner.

The transparency 40' is moved onto the grid 40 and oriented so that the lines of the transparency and grid are in registry which can occur in a number of relative positions. A position is selected such that the 0A facing on transparency 42' is positioned over a facing of a polygon on the grid 42 and included in the process calculating arrangement. The identification of that polygon facing is noted or otherwise recorded. That facing then is found in the polygon facing identification, i.e. Table I, and the corresponding page number is noted or otherwise recorded. Then the 0A facing is found on the grid 42 and the corresponding facing on transparency 42' is noted. That facing is found on the polygon facing identification in Table I. In the third column, i.e. the one identified Page Number, Object 2, the page number previously noted is entered. By way of example, assume transparency 42' is oriented relative to sheet 42 so that facing 0A on grid 40'is over facing 1F on grid 40. Page number 36 is noted from Table I under 1F, Page Number, Object 1. Then facing 0A on grid 40 is found to be in registry with facing 5B on transparency 42'. In the polygon facing identification, i.e. Table I, facing 5B is found and the previously noted page number 36 is entered in the other column, i.e. Page Number, Object 2. By way of further example, with facing 0A on the transparency in registry with facing 2A on the grid to yield page number 3 from Table I, facing 0A on the grid is in registry with facing 5A on the transparency and page 3 is recorded in the other column by facing 5A. Thus, page numbers corresponding to each facing for object 2 are generated. The foregoing is repeated for all of the facings in the process calculating arrangement until all of the page numbers for object 2 are derived in the polygon facing identification. These page numbers are for another of the books ultimately produced containing the pictures seen from another of the game objects.

Figure 9:
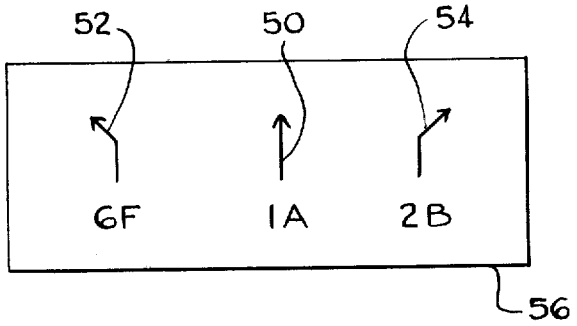
FIG. 9 is an elevational view of a sheet member for recording maneuver symbols at a stage of the method of the present invention.

Next, the movement capabilities of each game object are determined by ascertaining what the appropriate movements would be for each object. This is done by considering the polygon field of play involved when an object is in one of the polygons of grid 40 facing in a particular direction and by determining what new positions and facings the subject can move to in a given amount of time. For example, when the subject is in the central hexagon 0 of grid 40 and pointed toward the facing A of hexagon 0, it is determined what new positions and facings the subject can move to in a given amount of time. Each maneuver which determined is then identified by a symbol, and each new position is recorded as grid coordinates. Also, it is important that the symbols be drawn or formed so as to look like the maneuvers they represent. For example, starting in the central polygon 0 of grid 40 in FIG. 7, and moving in the direction toward the facing designated A, a maneuver in a straight forward direction is represented by a straight arrow such as symbol 50 shown in FIG. 9 and is identified with the coordinate 1A beneath it. This is because in a straight direction from the starting point the subject can travel within the polygon field of play defined by border 46 up to facing A of hexagon 1. A maneuver in the form of a left turn is represented by the symbol designated 52 in FIG. 9 which is in the form of an arrow with the head portion angled toward the left and with the coordinates 6F beneath it. This is because in the left-hand direction from the starting point the subject can move within the polygon field of play up to the facing F of hexagon 6. Finally, a maneuver in the form of a right turn is represented by the symbol designated 54 in FIG. 9 which is in the form of an arrow with the head portion angled to the right and the coordinate 2B beneath it. This is because in the right-hand direction from the starting point, the subject can travel within the field of view up to the facing B of hexagon 2. The symbols are recorded on a record member such as the sheet 56 of FIG. 9.

In the next stage of the method of the present invention, the picture generating elements are prepared and organized and the elements can be in the form of pages of the two books in the game of FIGS. 1–6, two decks or cards as previously mentioned, or other forms of picture generating elements. The pictures or graphical representations are set up in each of the the elements corresponding to facings for the subject when the target is at facing A of hexagon 0 in the grid 40. The polygon facing identification of Table I is used for numbering the pages. With two objects, i.e. subject and target in the illustrative game, there are two columns of page numbers in the polygon facing identification of Table I and thus there are two books or two decks of cards with the same pictorial or graphical relationship but different page numbers. While the game shown includes two airplanes, the game of course can include two entirely different objects. Thus, the number of books or the number of card decks or other structural arrangements is equal to the number of page number columns in the polygon identification of Table I. The maneuver symbols then are arranged on each picture generating element. In particular, the actual symbols are the same on each of the pictures or cards and the total number of maneuvers on each page or card is the same and the symbols are arranged at a conveniently viewable location relative to the picture. In an illustrative game, the three symbols on each page are located spaced below the picture as in the game of FIGS. 1–6. The arrangement is the same under each picture. Then all of the elements containing pictures as seen from the same object are gathered into one set, i.e. book or deck. In the game shown all the pages containing pictures of the German plane as seen from the Allied plane are gathered in one book, and all the pages having pictures of the Allied plane as seen from the German plane are gathered in the other book.

The next step in the method of the present invention is preparation of a maneuver code which is a relationship between all the maneuvers for the objects and the facings the maneuvers would result in when started from 0A. A maneuver code listing is prepared as shown in Table II wherein the three illustrative maneuvers are arranged at the top and in the left hand column as viewed in Table II all facings in the polygons-field of play of grid 40 are listed. For convenience, the Table is divided into two portions.

TABLE II

Maneuver Code Listing

| Facings | 6F | 1A | 2B | Facings | 6F | 1A | 2B |
|---|---|---|---|---|---|---|---|
| 0A | 4B | 4A | 4F | 3D | LOST | LOST | 3C |
| 0B | 4C | 4B | 4A | 3E | LOST | LOST | 3D |
| 0C | 4D | 4C | 4B | 3F | LOST | LOST | 3E |
| 0D | 4E | 4D | 4C | 4A | LOST | LOST | LOST |
| 0E | 4F | 4E | 4D | 4B | LOST | LOST | LOST |
| 0F | 4A | 4F | 4E | 4C | LOST | LOST | LOST |
| 1A | 3B | 0A | 5F | 4D | LOST | LOST | LOST |
| 1B | 3C | 0B | 5A | 4E | LOST | LOST | LOST |
| 1C | 3D | 0C | 5B | 4F | LOST | LOST | LOST |
| 1D | 3E | 0D | 5C | 5A | 5B | LOST | LOST |
| 1E | 3F | 0E | 5D | 5B | 5C | LOST | LOST |
| 1F | 3A | 0F | 5E | 5C | 5D | LOST | LOST |
| 2A | LOST | 3A | 0F | 5D | 5E | LOST | LOST |
| 2B | LOST | 3B | 0A | 5E | 5F | LOST | LOST |
| 2C | LOST | 3C | 0B | 5F | 5A | LOST | LOST |
| 2D | LOST | 3D | 0C | 6A | 0B | 5A | LOST |
| 2E | LOST | 3E | 0D | 6B | 0C | 5B | LOST |
| 2F | LOST | 3F | 0E | 6C | 0D | 5C | LOST |
| 3A | LOST | LOST | 3F | 6D | 0E | 5D | LOST |
| 3B | LOST | LOST | 3A | 6E | 0F | 5E | LOST |
| 3C | LOST | LOST | 3B | 6F | 0A | 5F | LOST |

The facings of the code arrangement are generated in the following manner, the procedure being followed for each of the 42 facings listed in Table II and for each of the three illustrative maneuvers. Starting with a facing listed in the left hand column, the identification of that facing is located on transparency 40' and the transparency is placed on the grid 40 so that the facing identified on the transparency overlaps or is in registry with the facing identification on grid 40 corresponding to the first maneuver. All of the grid lines on the transparency must overlap exactly the grip lines on the sheet 42. Next, the facing identified in the left hand column of Table II is located on the grid 40 and then the facing identification on the transparency 42' in registry or directly above it is recorded in Table II under the maneuver. The foregoing procedure is repeated for the next maneuver, than for the third maneuver whereupon the entire procedure is repeated for the next facing identified in the left hand column of Table II until the entire Table is completed.

By way of example, referring to Table II consider the facing 0A in the first row of the Table and the maneuver designated 6F. The transparency 40' is placed on the grid 40 with the facing 0A of the transparency over the facing 6F of the grid. The transparency and the grid are adjusted so that all the lines are in registry, then the facing 0A is found on the grid and directly above that on the transparency the facing 4B is found which is recorded in Table II below the maneuver 6F. Next, the maneuver designated 1A is considered, and the facing 0A of the transparency is placed over the facing 1A on the grid, the facing 0A is found on the grid and this yields facing 4A in registry directly above it on the transparency and 4A is recorded in Table II under the maneuver 1A. Finally, the third maneuver designated 2B is considered and facing 0A on the transparency is placed over facing 2B on the grid, the facing 0A is found on the grid and this yields facing 4F directly above on the transparency. The facing 4F is recorded under the maneuver 2B as shown in Table II. Thus, the row of maneuver codes for the facing 0A is completed. Then one proceeds to the next row which is for facing 0B. For example, the facing 0A on the transparency is placed over the facing 6F on the grid corresponding to the first maneuver, the facing 0B is found on the grid and this yields facing 4C from the transparency which is recorded in Table II. Next, considering the maneuver 1A, the facing 0A on the transparency is placed over facing 1A on the grid, the facing 0B is found on the grid and this yields facing 4B from the transparency which is recorded in the Table. Finally, considering maneuver 2B, facing 0A on the transparency is placed over facing 2B on the grid, the facing 0B is found on the grid and this yields facing 4A on the transparency which is recorded on the Table. This completes the maneuver codes for the facing 0B and the foregoing procedure is repeated for the remaining 40 facings listed in Table II. When the facing on the grid is in registry with a polygon on the transparency which is on the outside of the polygon field of play, i.e. outside of the border designated 46', there will be no code generated and instead "lost" is entered in the maneuver code listing. This indicates the condition wherein the two game objects are lost to each other, i.e. representing the condition where the two airplanes are flying away from each other in opposite directions.

Next, a maneuver destination listing is prepared for each game object. In particular, destinations in the form of page numbers are generated for each of the maneuvers shown on each of the picture generating elements, i.e. in the present illustration for the three maneuvers on each page, and this is done for each of the game objects, which in the present illustration includes two objects. In the present illustration, a listing first is prepared for all of the picture generating elements, i.e. the book pages or deck cards for one game object, and then a listing is prepared for all picture generating elements for the other object. Table III is a maneuver page listing for the one game object which is identified as object number 1 and Table IV is a maneuver page listing for the other game object identified as object number 2.

TABLE III

| Maneuver Page Listing For Game Object Number One | | | | | | | |
|---|---|---|---|---|---|---|---|
| Page Nos. Object 1 | 6F | 1A | 2B | Page Nos. Object 1 | 6F | 1A | 2B |
| 1 | 38 | 17 | LOST | 22 | LOST | LOST | 15 |
| 2 | 22 | 37 | 12 | 23 | LOST | LOST | LOST |
| 3 | LOST | 15 | 39 | 24 | 30 | LOST | LOST |

TABLE III-continued

| Maneuver Page Listing For Game Object Number One | | | | | | | |
|---|---|---|---|---|---|---|---|
| Page Nos. Object 1 | 6F | 1A | 2B | Page Nos. Object 1 | 6F | 1A | 2B |
| 4 | LOST | LOST | 28 | 25 | 39 | 32 | LOST |
| 5 | LOST | LOST | LOST | 26 | 10 | 40 | 6 |
| 6 | 32 | LOST | LOST | 27 | LOST | 34 | 42 |
| 7 | 41 | 24 | LOST | 28 | LOST | LOST | 22 |
| 8 | 28 | 38 | 17 | 29 | LOST | LOST | LOST |
| 9 | LOST | 22 | 37 | 30 | 6 | LOST | LOST |
| 10 | LOST | LOST | 34 | 31 | 37 | 12 | LOST |
| 11 | LOST | LOST | LOST | 32 | 12 | LOST | LOST |
| 12 | 17 | LOST | LOST | 33 | LOST | LOST | LOST |
| 13 | 4 | 41 | 24 | 34 | LOST | LOST | 4 |
| 14 | LOST | 28 | 38 | 35 | LOST | 10 | 40 |
| 15 | LOST | LOST | 10 | 36 | 15 | 39 | 32 |
| 16 | LOST | LOST | LOST | 37 | 23 | 16 | 11 |
| 17 | 24 | LOST | LOST | 38 | 29 | 23 | 16 |
| 18 | 42 | 30 | LOST | 39 | 16 | 11 | 33 |
| 19 | 40 | 6 | LOST | 40 | 11 | 33 | 5 |
| 20 | 34 | 42 | 30 | 41 | 5 | 29 | 23 |
| 21 | LOST | 4 | 41 | 42 | 33 | 5 | 29 |

TABLE IV

| Maneuver Page Listing For Game Object Number Two | | | | | | | |
|---|---|---|---|---|---|---|---|
| Page Nos. Object 2 | 6F | 1A | 2B | Page Nos. Object 2 | 6F | 1A | 2B |
| 1 | LOST | LOST | 8 | 22 | 3 | LOST | LOST |
| 2 | LOST | LOST | LOST | 23 | 37 | 22 | LOST |
| 3 | 36 | LOST | LOST | 24 | 1 | 38 | 29 |
| 4 | LOST | LOST | 33 | 25 | 6 | LOST | LOST |
| 5 | LOST | LOST | LOST | 26 | 42 | 25 | LOST |
| 6 | 29 | LOST | LOST | 27 | 4 | 40 | 36 |
| 7 | LOST | 8 | 41 | 28 | LOST | LOST | LOST |
| 8 | LOST | LOST | 14 | 29 | 22 | LOST | LOST |
| 9 | LOST | LOST | LOST | 30 | 38 | 29 | LOST |
| 10 | 33 | 39 | 3 | 31 | LOST | LOST | LOST |
| 11 | LOST | 12 | 37 | 32 | LOST | LOST | LOST |
| 12 | LOST | LOST | 1 | 33 | LOST | LOST | 12 |
| 13 | LOST | 14 | 42 | 34 | LOST | 33 | 39 |
| 14 | LOST | LOST | 4 | 35 | 40 | 36 | LOST |
| 15 | 39 | 3 | LOST | 36 | 25 | LOST | LOST |
| 16 | 12 | 37 | 22 | 37 | 31 | 2 | 9 |
| 17 | LOST | 1 | 38 | 38 | 2 | 9 | 28 |
| 18 | 8 | 41 | 6 | 39 | 32 | 31 | 2 |
| 19 | 41 | 6 | LOST | 40 | 5 | 32 | 31 |
| 20 | 14 | 42 | 25 | 41 | 9q | 28 | 5 |
| 21 | LOST | LOST | LOST | 42 | 28 | 5 | 32 |

For each object, each picture generating element, i.e. book page or card, corresponds to a facing of a geometric figure which can be determined from the polygon facing identification of Table I. Accordingly, that particular facing is determined and then found in the maneuver code listing of Table II. A new facing for the first maneuver is obtained and then found in the polygon facing identification for the particular object, i.e. number 1 or 2. The page number given on the polygon facing identification is recorded under the particular maneuver in the maneuver page listing. This is repeated for the other two maneuvers corresponding to that page, whereupon the foregoing procedure is repeated for all of the page numbers and then ultimately for both the game objects.

By way of illustration, starting with page number 1 for game object number 1 and referring to Table I, in the column for object number 1 page number 1 is found and this yields the facing designated 6A. Facing 6A then is found in the maneuver code listing of Table II under the first maneuver, i.e. the maneuver identified 6F, which yields a new facing OB. Then, returning to the polygon facing identification of Table I, in correspondence with facing 0B there is found the page number 38 in the column corresponding to object number 1. This page number is recorded in the maneuver code listing of Table III in the row for page number 1 under the first maneuver. Next, taking the facing 6A originally found in Table I for page number 1, object number 1, the facing 6A is found in Table II in the row for facing 6A there is located a new facing 5A. Returning to Table I the new facing 5A under game object 1 yields a page number 17 which is recorded in Table III under the second maneuver. Finally, taking the facing 6A originally found in Table I for page 1, object 1, under the third maneuver designated 2B in Table II there is found the designation "lost" which immediately is recorded in Table III. Thus, the page numbers for each of the three maneuvers on page 1 of the book for object number 1 have been determined. The foregoing procedure is repeated for page 2, and when finished for all 42 pages of the book for game object number 1, the procedure is repeated for the other object, i.e. object number 2. For example, starting with page 2, object 1 the facing 1A is found in Table I and used according to the foregoing procedure.

When the maneuver page listings for both of the game objects is completed, as illustrated by the completed Tables III and IV, for each page of each book the generated maneuver page numbers are recorded on the book pages adjacent the corresponding maneuver symbols, preferably below the symbols as shown in the illustrative game of FIGS. 1–6. Then the pages are arranged sequentially in each book and the game is ready for play in the manner described in conjunction with the game illustrated in FIGS. 1–6.

The heretofore described grid and transparency system can be easily expanded to include a multi-plane activity pattern including a plurality of grids and transparencies to provide a cubic or 3-dimensional reference for the desired activity.

It is therefore apparent that the present invention accomplishes its intended objects. While an embodiment of the present invention has been described in detail, this is for the purpose of illustration, not limitation.

I claim:

1. An action game-type activity for at least two players comprising:

(a) first means for generating a plurality of visual representations of two relatively movable and interacting game objects controlled by the two players, said generating means comprising a plurality of consecutively ordered picture generating elements, each element including a picture of one game object as seen from the other game object controlled by one of the players, each element depicting a different spatial relationship between the game objects;

(b) second means for generating a plurality of visual representations of two relatively movable and interacting game objects controlled by the two players, said generating means comprising a plurality of consecutively ordered picture generating elements, each element including a picture of the other game object as seen from the one game object controlled by another of the players, each element depicting a different spatial relationship between the game objects;

(c) a plurality of symbols of a first type on said picture generating elements each indicating a different selectable maneuver for the game object controlled by the player viewing the picture and controlling the object from which the picture is seen; and (d) a plurality of symbols of a second type on said picture generating elements in spaced, proximate relation to said first type symbols, there being one second type symbol for each first type symbol and located in visual correspondence therewith, said second type symbols serving as pointers to particular other ones of said picture generating elements as determined by selection of said maneuver symbols.

2. Apparatus according to claim 1, wherein each of said generating means comprises a book containing a plurality of pages serving as said picture generating elements.

3. Apparatus according to claim 1, wherein each of said generating means comprises a set of card-like elements each serving as one of said picture generating elements.

4. A method of making a game of the type wherein a plurality of sets of organized picture generating elements illustrate the interaction between game objects controlled by the player and show each player his own point of view of the action and allow each player his own choice of future actions, comprising the steps of:

(a) providing a grid comprising a pattern of interconnected geometric figures of the same size and shape, the grid pattern being selected to approximate motion and facing of said game objects;

(b) providing a transparency having a geometric pattern thereon identical to the pattern of said grid;

(c) defining a process calculating arrangement on said grid and on said transparency by outlining the periphery of the geometric figures surrounding a single, central geometric figure;

(d) determining the total number of picture generating elements in each set as the product of the number of geometric figures in said process calculating arrangement times the number of sides of any one geometric figure in said arrangement;

(e) preparing a listing of facing identifications of each of the geometric figures in said process calculating arrangement and randomly assigning a first series of different numbers to said facing identifications, there being one number assigned to each facing identification up to the previously determined total number of picture generating elements;

(f) assigning a second series of different numbers to said facing identifications in said listing, one number to each identification up to said total number of picture generating elements, by utilizing said transparency and said grid to develop a relationship between said facing identifications and the numbers in said first series to generate the numbers in said second series;

(g) providing a plurality of maneuver symbols each comprising a graphical representation of a game object maneuver and each identified by the facing within the process calculating arrangement wherein the game object would be located after the corresponding maneuver, each maneuver being determined by a relationship between the movement capabilities of the game object and said process calculating arrangement;

(h) providing a plurality of picture generating elements each containing a pictorial representation of one game object as viewed from the other and each having said maneuver symbols thereon in spaced relation to said pictorial representation and arranging said elements into separate sets depending upon which game object the pictorial representation is viewed from;

(i) preparing a maneuver code defining a relationship between all of said maneuvers and the facings of said figures of said process calculating arrangement encountered by said maneuver when initiated from the same point within said arrangement;

(j) preparing a listing of maneuver destinations for each game object from said maneuver code and said listing of facing identifications; and (k) recording said maneuver destinations on said picture generating elements in correspondence with said maneuver symbols and arranging said picture generating elements sequentially in each of said sets.

5. A method according to claim 4, wherein said step of assigning a second series of different numbers to said facing identifications in said listing comprises the steps of:

(a) placing said transparency on said grid in any of a number of possible positions wherein a selected facing on said transparency is in registry with a facing on said grid within said process calculating arrangement and with all facings of said transparency being in registry with all facings of said grid;

(b) recording the identification of the facing from said grid;

(c) locating the facing selected from said transparency on said grid, finding the aligned facing on said transparency, finding the identification of said aligned facing in said listing, and recording in said listing adjacent said aligned facing identification the number in said first series of numbers corresponding to said recorded identification of the facing from said grid; and (d) repeating said steps for each of the facings of all of the geometric figures in said process calculating arrangement.

6. A method according to claim 4, wherein said step of preparing a maneuver code comprises the steps of:

(a) listing the facing identifications of the geometric figures in said process calculating arrangement;

(b) placing said transparency on said grid in a position where a facing selected from said listing and identified on said transparency is in registry with the facing on said grid having the same identification as one of said maneuvers;

(c) locating the facing identification selected from said listing on said grid and finding the aligned facing identification on said transparency and recording and aligned facing identification in said listing in correspondence with the selected facing from said listing and said one maneuver; and (d) repeating said steps for each of the maneuvers and for all of said listed facing identifications.

7. A method according to claim 4, wherein said step of preparing a listing of maneuver destinations comprises the steps of:

(a) determining a facing from said identification for a particular picture generating element of one of said sets;

(b) locating said facing on said maneuver code relationship to obtain another facing corresponding to one of said maneuvers;

(c) locating said other facing in said listing of facing identifications to obtain a number destination;

(d) recording the number destination in correspondence with said particular picture generating element and with said one maneuver;

(e) repeating said steps for said particular picture generating element for the other of said maneuvers; and (f) repeating said steps for the remaining ones of said picture generating elements for all of said maneuvers.

8. Apparatus for making a game of the type wherein a plurality of sets of organized picture generating elements illustrate the interaction between objects controlled by the players and show each player his own point of view of the action and allow each player his own choice of future actions, said apparatus comprising:

(a) a grid comprising a first sheet element provided with a pattern thereon of interconnected geometric figures of the same size and shape;

(b) a transparency comprising a second sheet element of transparent material having a geometric pattern thereon identical to said pattern on said first sheet member;

(c) said patterns of said grid and said transparency each containing a defined process calculating arrangement including a central figure and the figures surrounding the central figure and contiguous with the sides of the central figure;

(d) a first record member containing a listing of the facing identifications of each of the geometric figures in said process calculating arrangement, a randomly assigned first series of different numbers arranged in correspondence with said listing and a second series of different numbers arranged in correspondence with said listing and generated from a relationship between said facing identifications and said numbers of said first series developed by utilizing said grid and said transparency;

(e) a second record member containing a listing of the facing identifications of each of the geometric figures in said process calculating arrangement and a maneuver code defining a relationship between symbols representing maneuvers of said objects and the facings of said figures of said process calculating arrangement encountered during said maneuvers when initiated from the same point within said arrangement; and (f) third and fourth record members, each comprising a listing of the picture generating elements of a corresponding one of said sets, each further comprising destination identifications corresponding to said maneuver symbols for each of said picture generating elements and derived from said maneuver code and said facing identifications.

* * * * *